US009655402B2

(12) United States Patent
Molyneux et al.

(10) Patent No.: US 9,655,402 B2
(45) **Date of Patent: *May 23, 2017**

(54) ELECTRONICALLY CONTROLLED BLADDER ASSEMBLY

(71) Applicant: NIKE, Inc., Beaverton, OR (US)

(72) Inventors: James Molyneux, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/723,762

(22) Filed: May 28, 2015

(65) Prior Publication Data

US 2015/0257482 A1 Sep. 17, 2015

Related U.S. Application Data

(63) Continuation of application No. 13/717,389, filed on Dec. 17, 2012, now Pat. No. 9,066,558.

(51) Int. Cl.

| | |
|---|---|
| ***A43B 13/20*** | (2006.01) |
| ***A43B 3/00*** | (2006.01) |
| ***A43B 7/14*** | (2006.01) |

(52) U.S. Cl.

CPC ..... *A43B 13/203* (2013.01); *A43B 3/0005* (2013.01); *A43B 7/14* (2013.01); *A43B 13/20* (2013.01); *Y10T 137/0318* (2015.04)

(58) Field of Classification Search

CPC ..... A43B 13/20; A43B 13/203; A43B 21/26; A43B 21/285; A43B 3/0005

USPC ..... 36/29, 88, 35 R, 37, 136

See application file for complete search history.

(56) References Cited

U.S. PATENT DOCUMENTS

| | | | |
|---|---|---|---|
| 4,183,156 | A | 1/1980 | Rudy |
| 4,219,945 | A | 9/1980 | Rudy |
| 4,936,029 | A | 6/1990 | Rudy |
| 5,042,176 | A | 8/1991 | Rudy |
| 5,586,067 | A | 12/1996 | Gross et al. |
| 5,713,141 | A | 2/1998 | Mitchell et al. |
| 5,794,361 | A | 8/1998 | Sadler |
| 5,813,142 | A | 9/1998 | Demon |
| 5,952,065 | A | 9/1999 | Mitchell et al. |
| 6,013,340 | A | 1/2000 | Bonk et al. |

(Continued)

FOREIGN PATENT DOCUMENTS

| | | | |
|---|---|---|---|
| CN | 1430476 | A | 7/2003 |
| WO | 01/78539 | A2 | 10/2001 |
| WO | 2006078082 | A1 | 7/2006 |

OTHER PUBLICATIONS

May 27, 2014(WO)—ISR and WO—App. No. PCT/US2013/075265.

*Primary Examiner* — Marie Bays

(74) *Attorney, Agent, or Firm* — Banner & Witcoff, Ltd.

(57) ABSTRACT

An electronically controlled bladder assembly includes an adjustable pressure bladder and a constant pressure reservoir connected by an electronically controlled valve. The electronically controlled valve is operated in a manner that inflates the adjustable bladder when the current pressure is below a target pressure and in a manner that deflates the adjustable bladder when the current pressure is above the target pressure. The inflation and deflation of the adjustable bladder are achieved in an iterative manner by controlling the flow of fluid between the constant pressure reservoir and the adjustable bladder over several cycles of heel strikes.

17 Claims, 6 Drawing Sheets

(56) References Cited

U.S. PATENT DOCUMENTS

| | | | | |
|---|---|---|---|---|
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,889,451 | B2 | 5/2005 | Passke et al. | |
| 6,892,477 | B2 | 5/2005 | Potter et al. | |
| 7,013,585 | B2 | 3/2006 | Lo | |
| 7,188,439 | B2 | 3/2007 | DiBenedetto et al. | |
| 7,219,449 | B1 | 5/2007 | Hoffberg et al. | |
| 7,428,471 | B2 | 9/2008 | Darley et al. | |
| 7,771,320 | B2 | 8/2010 | Riley et al. | |
| 7,793,430 | B2 | 9/2010 | Ellis | |
| 8,056,268 | B2 | 11/2011 | DiBenedetto et al. | |
| 8,112,251 | B2 | 2/2012 | Case, Jr. et al. | |
| 8,117,766 | B2 | 2/2012 | Gornatti | |
| 9,066,558 | B2 * | 6/2015 | Molyneux | A43B 13/203 |
| 2003/0009910 | A1 | 1/2003 | Pavone | |
| 2006/0196081 | A1 | 9/2006 | Lee | |
| 2007/0021269 | A1 | 1/2007 | Shum | |
| 2010/0063778 | A1 | 3/2010 | Schrock et al. | |
| 2011/0032105 | A1 | 2/2011 | Hoffman et al. | |
| 2011/0040220 | A1 | 2/2011 | Holgreen | |
| 2011/0047830 | A1 | 3/2011 | Francello et al. | |
| 2011/0199393 | A1 | 8/2011 | Nurse et al. | |
| 2012/0078396 | A1 | 3/2012 | Case, Jr. et al. | |
| 2012/0084998 | A1 | 4/2012 | Biesse | |
| 2012/0234111 | A1 | 9/2012 | Molyneux et al. | |
| 2012/0251079 | A1 | 10/2012 | Meschter et al. | |
| 2012/0255195 | A1 | 10/2012 | Langvin et al. | |
| 2012/0255196 | A1 | 10/2012 | Gishifu et al. | |
| 2012/0255198 | A1 | 10/2012 | Langvin et al. | |
| 2012/0291563 | A1 | 11/2012 | Schrock et al. | |
| 2012/0291564 | A1 | 11/2012 | Amos et al. | |
| 2013/0278436 | A1 | 10/2013 | Ellis | |

* cited by examiner

ELECTRONICALLY CONTROLLED BLADDER ASSEMBLY

CROSS-REFERENCE TO RELATED APPLICATION

This application is a continuation of U.S. application Ser. No. 13/717,389, titled "Electronically Controlled Bladder Assembly" and filed Dec. 17, 2012, which application is incorporated by reference herein.

BACKGROUND

The present embodiments relate generally to footwear and in particular to articles of footwear with bladder assemblies and methods of controlling bladder assemblies.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole structure is secured to a lower portion of the upper so as to be positioned between the foot and the ground. In athletic footwear, for example, the sole structure may include a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

In one aspect, an article of footwear includes a bladder and a reservoir, where the pressure of the bladder is adjustable and wherein the pressure of the reservoir is substantially constant. The article also includes an electronically controlled valve including a first fluid port in fluid communication with the bladder and a second fluid port in fluid communication with the reservoir. The article also includes a pressure sensor associated with the bladder and an electronic control unit for controlling the electronically controlled valve, where the electronic control unit receives information from the pressure sensor. The electronic control unit is configured to operate the electronically controlled valve in an iterative manner to achieve a target pressure for the bladder.

In another aspect, a method of controlling an electronically controlled valve in an article of footwear, where the electronically controlled valve provides controllable fluid communication between an adjustable bladder and a constant pressure reservoir, includes receiving a current bladder pressure for the adjustable bladder, receiving information associated with a first heel strike event and receiving information associated with a second heel strike event. The method further includes comparing the current bladder pressure with a target pressure. The method includes lowering the current bladder pressure when the current bladder pressure is substantially greater than the target pressure by opening the electronically controlled valve for a first period of time in response to the first heel strike event and opening the electronically controlled valve for a second period of time in response to the second heel strike event, and by closing the electronically controlled valve for a third period of time that occurs between the first period of time and the second period of time.

In another aspect, a method of controlling an electronically controlled valve in an article of footwear, where the electronically controlled valve provides controllable fluid communication between an adjustable bladder and a constant pressure reservoir, includes receiving a current bladder pressure for the adjustable bladder, receiving information associated with a first heel strike event and receiving information associated with a second heel strike event. The method further includes comparing the current bladder pressure with a target pressure. The method also includes increasing the current bladder pressure whenever the current bladder pressure is substantially less than the target pressure by closing the electronically controlled valve for a first period of time in response to the first heel strike event and closing the electronically controlled valve for a second period of time in response to the second heel strike event, and by opening the electronically controlled valve for a third period of time that occurs between the first period of time and the second period of time.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
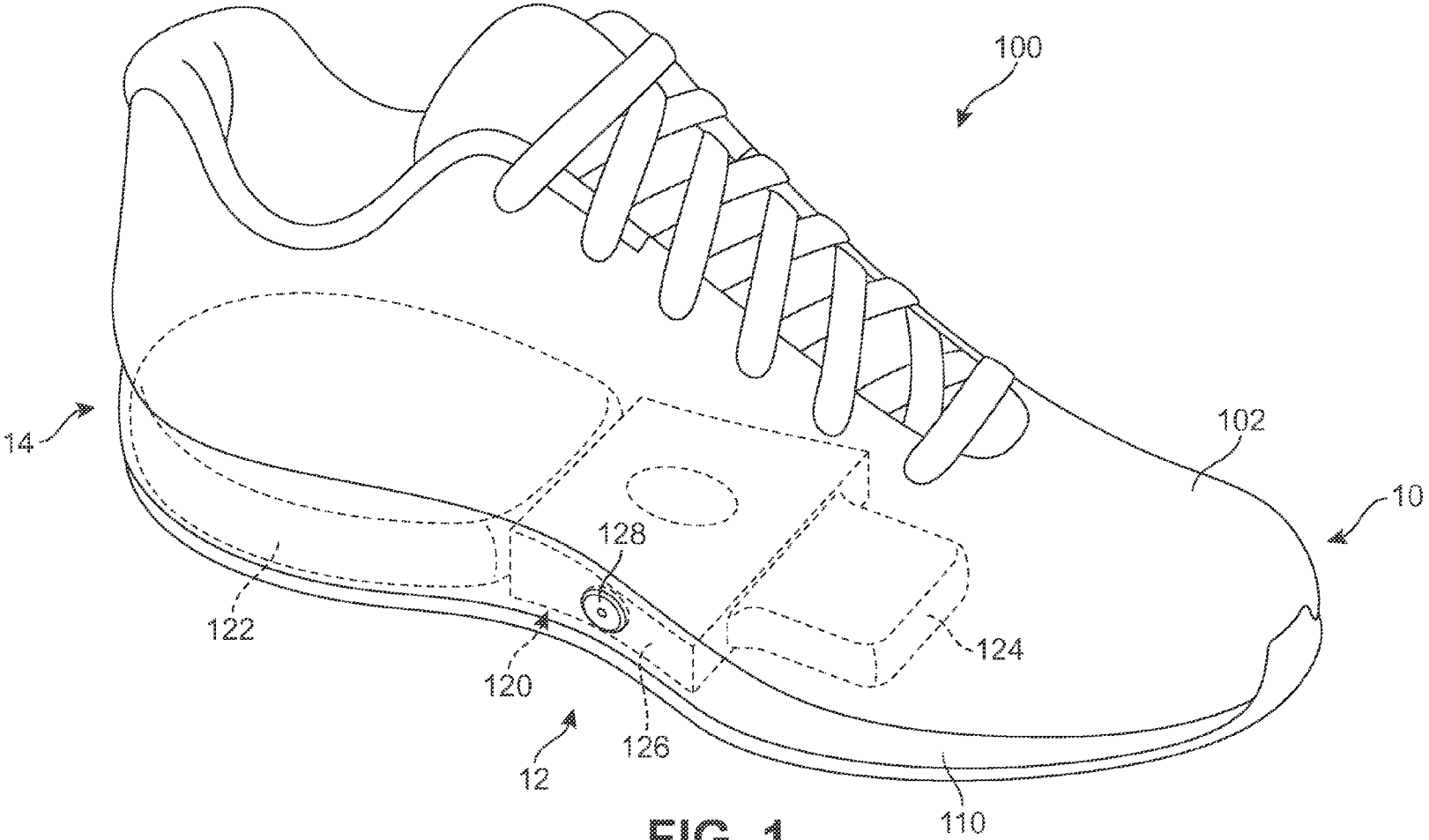
FIG. 1 is a schematic isometric view of an embodiment of an article of footwear including a bladder assembly.

FIG. 1 illustrates a schematic isometric view of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. It will be understood that forefoot portion 10, midfoot portion 12 and heel portion 14 are only intended for purposes of description and are not intended to demarcate precise regions of article 100.

For consistency and convenience, directional adjectives are employed throughout this detailed description corresponding to the illustrated embodiments. The term "longitudinal" as used throughout this detailed description and in the claims refers to a direction extending a length of a component. In some cases, the longitudinal direction may extend from a forefoot portion to a heel portion of the article. Also, the term "lateral" as used throughout this detailed description and in the claims refers to a direction extending a width of a component, such as an article. For example, the lateral direction may extend between a medial side and a lateral side of an article. Furthermore, the term "vertical" as used throughout this detailed description and in the claims refers to a direction that is perpendicular to both the longitudinal and lateral directions. In situations where an article is placed on a ground surface, the upwards vertical direction may be oriented away from the ground surface, while the downwards vertical direction may be oriented towards the ground surface. It will be understood that each of these directional adjectives may be also be applied to individual components of article 100 as well.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Some embodiments of article 100 can include provisions for shock absorption, cushioning and comfort. In some cases, article 100 may be provided with one or more bladders. A bladder may be filled with one or more fluids, including gases and/or liquids. In some embodiments, a bladder can be configured to receive a gas including, but not limited to: air, hydrogen, helium, nitrogen or any other type of gas including a combination of any gases. In other embodiments, the bladder can be configured to receive a liquid, such as water or any other type of liquid including a combination of liquids. In an exemplary embodiment, a fluid used to fill a bladder can be selected according to desired properties such as compressibility. For example, in cases where it is desirable for a bladder to be substantially incompressible, a liquid such as water could be used to fill the inflatable portion. Also, in cases where it is desirable for a bladder to be partially compressible, a gas such as air could be used to fill the inflatable portion. It is also contemplated that some embodiments could incorporate bladders filled with any combinations of liquids and gases.

In one embodiment, article 100 includes bladder assembly 120, which may include provisions to enhance shock absorption, cushioning, energy return and comfort. Bladder assembly 120 may incorporate one or more bladders, as well as additional provisions for controlling or otherwise facilitating the operation of these bladders. Bladders may comprise fixed pressure bladders and/or adjustable pressure bladders (also referred to simply as adjustable bladders). Additionally, a bladder assembly can include various provisions such as valves, fluid lines, housing and additional provisions for controlling the flow of fluid into and/or out of one or more bladders.

Figure 2:
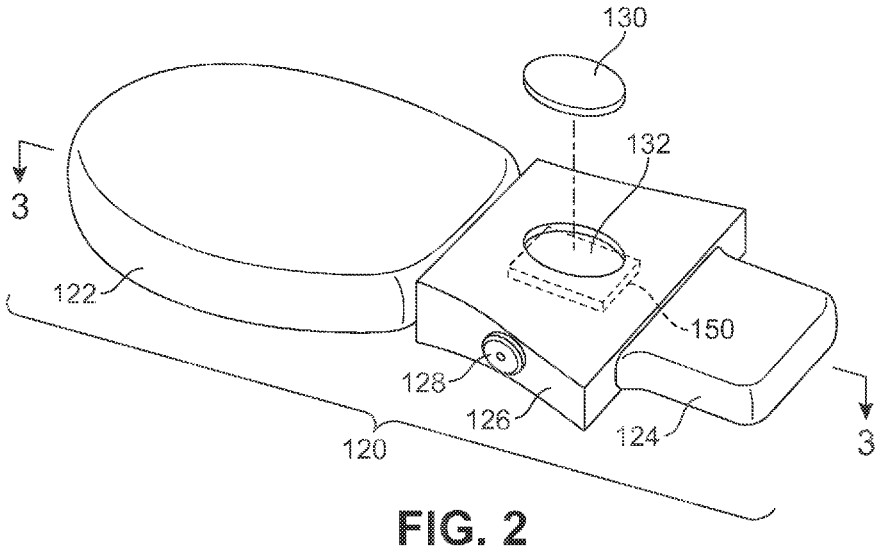
FIG. 2 is a schematic isometric view of an embodiment of a bladder assembly in isolation.

FIG. 2 illustrates a schematic isometric view of bladder assembly 120 in isolation from other components of article 100. Referring now to FIGS. 1 and 2, in some embodiments, bladder assembly 120 may include bladder 122. In some embodiments, bladder 122 may be an adjustable pressure bladder, also referred to simply as an adjustable bladder. In contrast to fixed pressure bladders, the internal pressure of an adjustable bladder may vary. In particular, an adjustable bladder may include provisions for receiving and/or releasing fluid, using one or more valves, for example.

Figure 3:
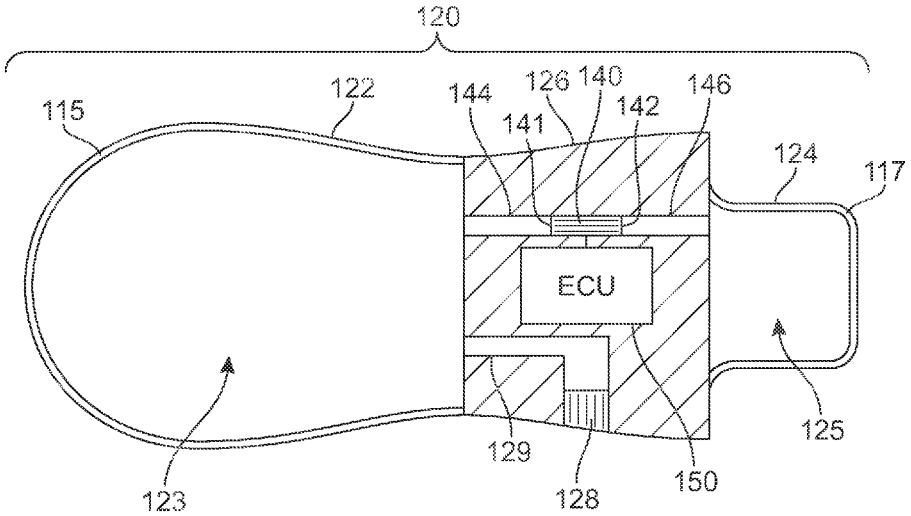
FIG. 3 is a schematic cross-sectional view of an embodiment of a bladder assembly.

Bladder 122 may generally comprise an outer barrier layer 115 that encloses an interior cavity 123 (see FIG. 3). Outer barrier layer 115 may be impermeable to some fluids such that outer barrier layer 115 prevents some kinds of fluids from escaping interior cavity 123. Although a single outer barrier layer is shown in these embodiments, other embodiments could incorporate bladders having any other number of layers. In some other embodiments, for example, a bladder could comprise various layers that define one or more distinct interior chambers. Moreover, as discussed below, some embodiments of a bladder may incorporate additional provisions, such as structures disposed within an interior cavity to help control compression and response of the bladder to other forces.

Bladder 122 may be disposed on any portion of article 100. In some embodiments, bladder 122 could be disposed in upper 102. In other embodiments, bladder 122 could be disposed in sole structure 110. Moreover, bladder 122 could be disposed in one or more of forefoot portion 10, midfoot portion 12 and/or heel portion 14. In the exemplary embodiment shown in the figures, bladder 122 is disposed in the heel portion 14 of sole structure 110. This location may facilitate cushioning, energy storage and/or shock absorption for the heel of the foot, which may contact the ground first in some kinds of activities (e.g., during a heel strike).

In different embodiments, the geometry of bladder 122 can vary. In the embodiment shown in FIGS. 1 and 2, bladder 122 has a geometry that approximately corresponds to the heel portion of sole structure 110 into which bladder 122 is embedded. However, in other embodiments, bladder 122 could have any other geometry that could be selected according to various factors including location, structural requirements of the bladder, aesthetic or design factors as well as possibly other factors.

Although a single adjustable pressure bladder is shown in the current embodiment, other embodiments could include any other number of adjustable pressure bladders. For example, another embodiment could include two or more stacked adjustable pressure bladders. In still another embodiment, multiple adjustable pressure bladders could be incorporated into various different regions of sole structure 110 and/or upper 102.

A bladder may incorporate additional structural provisions for controlling compressibility as well as possibly other structural characteristics. As an example, some bladders can include one or more tensile materials disposed within an internal cavity of the bladders, which can help control the shape, size and compressibility of the bladders. Some examples of bladders with tensile materials that could be used with bladder assembly 120 are disclosed in Langvin, U.S. Patent Application Publication Number 2012/0255196 (U.S. patent application Ser. No. 13/081,069, filed Apr. 6, 2011, and titled "Adjustable Bladder System for an Article of Footwear") and in Langvin, U.S. Patent Application Publication Number 2012/0255198 (U.S. patent application Ser. No. 13/081,091, filed Apr. 6, 2011, and titled "Adjustable Multi-Bladder System for an Article of Footwear"), the entirety of both being hereby incorporated by reference.

Bladder assembly 120 can include valve housing 126 that facilitates the inflation of bladder 122. Valve housing 126 may be disposed adjacent to bladder 122. In some embodiments, valve housing 126 comprises a plug-like member that receives intake valve 128 and supports the transfer of fluid into bladder 122. In some embodiments, valve housing 126 may be substantially more rigid than bladder 122. This arrangement helps protect valve 128 as well as any tubing or fluid lines connected to valve 128. In other embodiments, however, the rigidity of valve housing 126 could be substantially less than or equal to the rigidity of bladder 122.

In some embodiments, bladder assembly 120 may include one or more fluid reservoirs. In one embodiment, bladder assembly 120 includes reservoir 124. In particular, in some embodiments, reservoir 124 may be a constant pressure reservoir. In the current embodiment, reservoir 124 is shown schematically as including an outer barrier layer 117 and an interior cavity 125 (see FIG. 3). However, in other embodiments, reservoir 124 could include additional structures or provisions to provide an approximately constant interior pressure for interior cavity 125. Maintaining reservoir 124 at a constant pressure can be achieved using any methods known in the art. Any combination of valves, pumps and/or other features could be used to maintain a substantially constant pressure for reservoir 124 throughout various operating states of bladder assembly 120. Moreover, any valves and/or pumps that may be used could be mechanically actuated and/or electromagnetically actuated.

Reservoir 124 is generally associated with valve housing 126 and may be in fluid communication with portions of valve housing 126 as described in detail below. In some embodiments, bladder 122 and reservoir 124 may be disposed on opposing sides, or faces, of valve housing 126. For example, in the current embodiment reservoir 124 is disposed forwards of both bladder 122 and valve housing 126, so that reservoir 124 may be disposed in the midfoot portion 12 and/or forefoot portion 10 of sole structure 110. However, in other cases, the relative arrangement of bladder 122 and reservoir 124 with respect to valve housing 126 could vary to achieve desired geometries, structural constraints or other desirable properties for bladder assembly 120.

Materials that may be useful for forming one or more layers of a bladder can vary. In some cases, bladder 122 may comprise of a rigid to semi-rigid material. In other cases, bladder 122 may comprise of a substantially flexible material. Bladder 122 may be made of various materials in different embodiments. In some embodiments, bladder 122 can be made of a substantially flexible and resilient material that is configured to deform under fluid forces. In some cases, bladder 122 can be made of a plastic material. Examples of plastic materials that may be used include high density polyvinyl-chloride (PVC), polyethylene, thermoplastic materials, elastomeric materials as well as any other types of plastic materials including combinations of various materials. In embodiments where thermoplastic polymers are used for a bladder, a variety of thermoplastic polymer materials may be utilized for the bladder, including polyurethane, polyester, polyester polyurethane, and polyether polyurethane. Another suitable material for a bladder is a film formed from alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A bladder may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference. In one embodiment, bladder 122 may comprise one or more layers of thermoplastic-urethane (TPU).

A reservoir can be constructed using any materials. In some embodiments, a reservoir, such as a constant pressure reservoir, can be made of a substantially similar material to an adjustable bladder. In some cases, for example, reservoir 124 may be made of a similar material to bladder 122. In other embodiments, however, a reservoir can be made of substantially different materials from a bladder. In some other embodiments, for example, a reservoir could be made of substantially rigid materials that do not deform or compress. Examples of such materials may include substantially rigid plastic materials, as well as composite materials that are substantially impermeable to some kinds of fluids.

FIG. 3 illustrates a schematic view of an embodiment of bladder assembly 120, including one or more components that may be disposed internally to valve housing 126. In some embodiments, valve housing 126 may be configured to deliver fluid between an external pump and interior cavity 123 of bladder 122. In some cases, an interior portion of valve housing 126 can include fluid passage 129. Fluid passage 129 may be a hollowed out portion of valve housing 250. In some cases, a tube or fluid line may be disposed within fluid passage 129. In other cases, fluid may travel through fluid passage 129 directly, without the use of a separate tube or fluid line. In the current embodiment, fluid line 129 extends between valve 128 and interior cavity 123 of bladder 122. This arrangement provides fluid communication between interior cavity 123 and an external pump that may be engaged with valve 128 so that fluid can be added to bladder assembly 120.

Generally, valve 128 may be any type of valve that is configured to engage with an external pump of some kind. In one embodiment, valve 128 could be a Schrader valve. In another embodiment, valve 128 could be a Presta valve. In still other embodiments, valve 128 could be any other type of valve known in the art.

A bladder assembly can include provisions for automatically adjusting the pressure of one or more bladders in response to user input and/or sensed information. In some embodiments, a bladder assembly can include provisions for automatically adjusting the flow of fluid between an adjustable bladder and a constant pressure reservoir. In one embodiment, for example, a bladder assembly can include an electronically controlled valve for controlling the flow of fluid between an adjustable bladder and a constant pressure reservoir, as well as a control unit for controlling the electronically controlled valve.

Referring to FIGS. 2 and 3, in some embodiments, bladder assembly 120 may include electronically controlled valve 140 and electronic control unit 150, also referred to as ECU 150, which is described in further detail below. Electronically controlled valve 140 may include a first fluid port 141 and a second fluid port 142 that are in fluid communication with fluid channel 144 and fluid channel 146, respectively. Moreover, this arrangement places first fluid port 141 in fluid communication with interior cavity 123 and places second fluid port 142 in fluid communication with interior cavity 125. With this configuration, electronically controlled valve 140 may control fluid communication between reservoir 124 and bladder 122.

Electronically controlled valve 140 could be any type of valve. Examples of different kinds of valves that could be used include, but are not limited to: solenoid valves, electronically controlled proportioning valves (ECV's), as well as other kinds of electronically controlled valves known in the art.

In the current embodiment, components of bladder assembly 120 may be disposed, or embedded, within a base material comprising sole structure 110. For example, in some cases, bladder assembly 120 may be disposed in a foam midsole. In some embodiments, some portions of bladder assembly 120 may be visible on the outer sidewalls of sole structure 110. In other embodiments, however, all of the components of bladder assembly 120 may be hidden.

Figure 4:
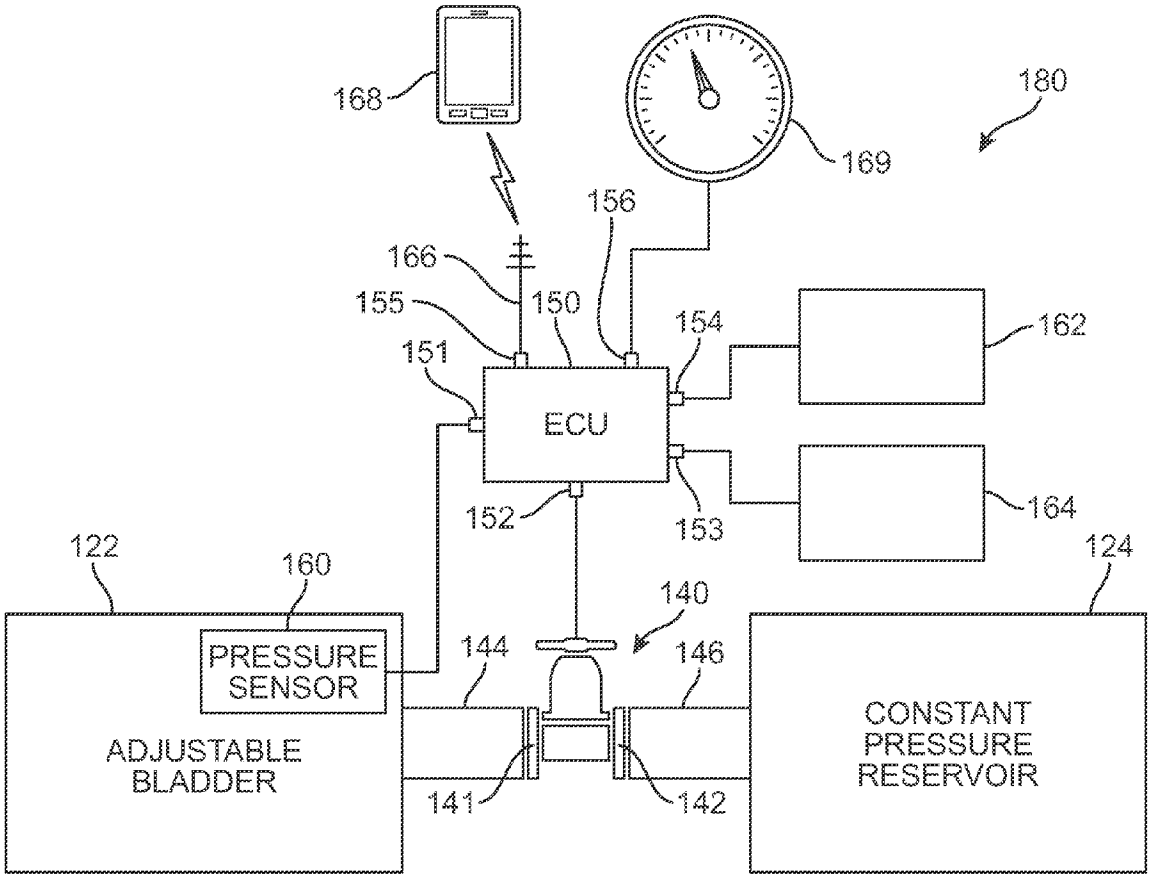
FIG. 4 is a schematic view of an embodiment of components of a bladder control system.

FIG. 4 illustrates a schematic view of various components of bladder assembly 120 that are in communication with ECU 150. ECU 150 may include a microprocessor, RAM, ROM, and software all serving to monitor and control various components of bladder assembly 120, as well as other components or systems of article 100. For example, ECU 150 is capable of receiving signals from numerous sensors, devices, and systems associated with bladder assembly 120. The output of various devices is sent to ECU 150 where the device signals may be stored in an electronic storage, such as RAM. Both current and electronically stored signals may be processed by a central processing unit (CPU) in accordance with software stored in an electronic memory, such as ROM.

ECU 150 may include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 150 are optional. Some embodiments may include a given port or provision, while others may exclude it. The following description discloses many of the possible ports and provisions that can be used, however, it should be kept in mind that not every port or provision must be used or included in a given embodiment.

In some embodiments, ECU 150 can include provisions for communicating and/or controlling various systems associated with bladder assembly 120. In some embodiments, ECU 150 may include port 151 for receiving information related to the pressure of fluid in bladder 122. In one embodiment, ECU 150 may receive pressure information from pressure sensor 160, which may be located, for example, in bladder 122.

ECU 150 may also include ports for receiving additional information from one or more sensors. In one embodiment, ECU 150 may include port 154 and port 153 for receiving information from first sensor 162 and second sensor 164, respectively. As an example, in one embodiment, first sensor 162 could be a gyroscope and second sensor 164 could be an accelerometer. In other embodiments, however, first sensor 162 and second sensor 164 could be any other kinds of sensors known in the art for use with footwear and/or apparel. Moreover, three sensors (pressure sensor 160, first sensor 162 and second sensor 164) are shown for purposes of illustration, but other embodiments could incorporate any other number of sensors according to the information required to operate ECU 150. Examples of sensory information that may be received by ECU 150 via one or more sensors includes, but is not limited to: pressure information, acceleration information, distance information, speed information, rotation information (i.e., the rotation angle of the system with respect to a horizontal surface), direction information, height information, as well as possibly other kinds of information. Furthermore, in some embodiments, some information could be obtained using a GPS device, which may allow the ECU 150 to determine location, speed and acceleration of the article of footwear, for example.

Referring back to FIG. 2, a possible location for one or more sensors is shown schematically as removable sensing unit 130. In particular, removable sensing unit 130 comprises an assembly of one or more sensors that can be easily inserted into, and removed from, recess 132 of valve housing 126. The location of removable sensing unit 130 is only intended as one possible location for one or more sensors associated with bladder assembly 120, and in other embodiments one or more sensors could be located in any portions of article 100 including sole structure 110 and/or upper 102. Moreover, the location of each sensor could vary according to the type of information being sensed.

Other inputs from sensors may be used to influence the performance or operation of the system. Some embodiments may use one or more of the sensors, features, methods, systems and/or components disclosed in the following documents: Case et al., U.S. Pat. No. 8,112,251, issued Feb. 7, 2012; Riley et al., U.S. Pat. No. 7,771,320, issued Aug. 10, 2010; Darley et al., U.S. Pat. No. 7,428,471, issued Sep. 23, 2008; Amos et al., U.S. Patent Application Publication Number 2012/0291564, published Nov. 22, 2012; Schrock et al., U.S. Patent Application Publication Number 2012/0291563, published Nov. 22, 2012; Meschter et al., U.S. Patent Application Publication Number 2012/0251079, published Oct. 4, 2012; Molyneux et al., U.S. Patent Application Publication Number 2012/0234111, published Sep. 20, 2012; Case et al., U.S. Patent Application Publication Number 2012/0078396, published Mar. 29, 2012; Nurse et al., U.S. Patent Application Publication Number 2011/0199393, published Aug. 18, 2011; Hoffman et al., U.S. Patent Application Publication Number 2011/0032105, published Feb. 10, 2011; Schrock et al., U.S. Patent Application Publication Number 2010/0063778, published Mar. 11, 2010; Shum, U.S. Patent Application Publication Number 2007/0021269, published Jan. 25, 2007; Schrock et al., U.S. Patent Application Publication Number 2013/0213147 (U.S. patent application Ser. No. 13/401,918, filed Feb. 22, 2012, titled "Footwear Having Sensor System"); Schrock et al., U.S. Patent Application Publication Number 2013/0213144 (U.S. patent application Ser. No. 13/401,910, filed Feb. 22, 2012, titled "Footwear Having Sensor System"), where the entirety of each document is incorporated by reference.

Some embodiments could include provisions that allow a user to input information to a bladder control system. Some embodiments could include one or more user input devices as well as provisions for communicating with the user input devices. For example, in some embodiments, ECU 150 may include port 155 that receives information from remote device antenna 166. In some embodiments, remote device antenna 166 is further in communication with remote device 168, which could be any kind of remote device including a cell phone, laptop, smartphone (such as the iPhone made by Apple, Inc.) as well as any other kind of remote device. In embodiments incorporating provisions for communicating with a remote device, a user may use the remote device to set a target pressure of a bladder control system. In some embodiments, EC 150 may include port 156 for receiving signals from a pressure control knob 169, which allows a user to manually set a desired or target pressure for bladder 122. In some embodiments, pressure control knob 169 could be disposed on a portion of article 100. In still other embodiments, any other provisions for receiving user input information could be incorporated into bladder control system 180. Other examples of possible user input devices that could receive user set information (such as a desired pressure for the bladder as well as possibly other settings) include, but are not limited to: control buttons, control panels, voice actuated devices as well as other user input devices. As described here, in some embodiments, a user input device may communicate with ECU 150 remotely, while in other embodiments a user input device could be communicate in a wired manner with ECU 150. It is also contemplated that in some other embodiments, a remote device or other device could receive information from ECU 150, including, for example, the current bladder pressure of bladder 122. This information may be displayed to a user in real time for monitoring various aspects of bladder assembly 120.

In some embodiments, one or more components of a bladder assembly may be configured as part of a bladder control system. For example, in the embodiment shown in FIG. 4, ECU 150, pressure sensor 160, first sensor 162, second sensor 164, electronically controlled valve 140, remote device 168, and pressure control knob 169 may all be collectively referred to as a bladder control system 180. In particular, bladder control system 180 may comprise various provisions for sensing or otherwise receiving information and controlling electronically controlled valve 140 accordingly. The components described here as comprising bladder control assembly 180 are only intended to be exemplary, and in other embodiments some of these components could be optional. Moreover, in embodiments including various additional sensors or devices that communicate with ECU 150, these additional sensors or devices can be considered as part of bladder control system 180.

Throughout the detailed description and in the claims a bladder control system can be configured to operate in one or more operating modes. In some embodiments, a bladder control system can operate in an "inflation mode", which is a mode where the pressure in an adjustable bladder is increased through the automated operation of an electronically controlled valve. In some embodiments, a bladder control system can operate in a "deflation mode", which is a mode where the pressure in an adjustable bladder is decreased through the automated operation of an electronically controlled valve. Detailed methods for operating in the inflation mode or the deflation mode are discussed in further detail below.

Figure 5:
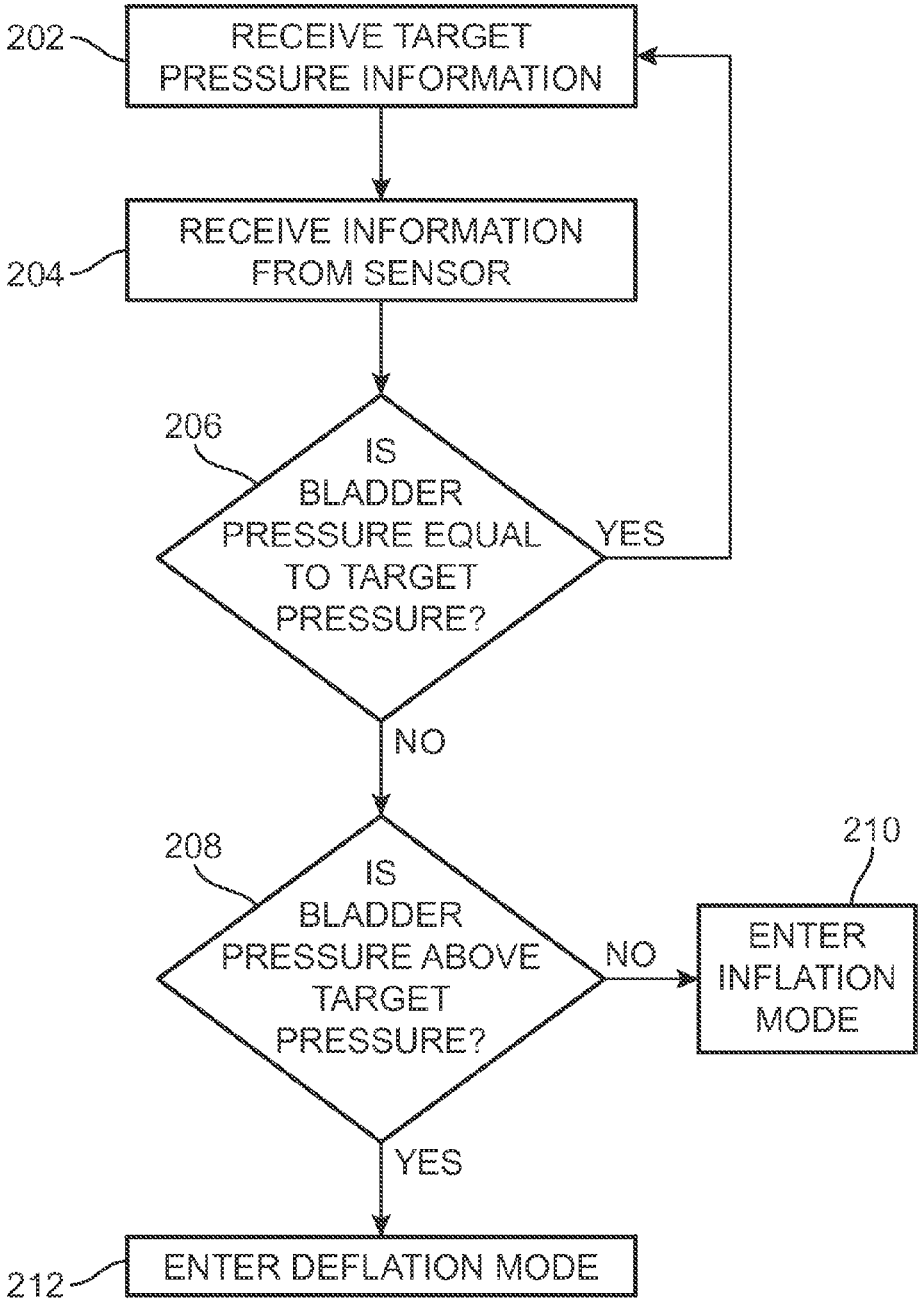
FIG. 5 is a schematic process for operating a bladder control system according to an embodiment.

FIG. 5 illustrates an embodiment of a process for selecting an operating mode for a bladder control system according to information about the state of an adjustable bladder. In some embodiments, some of the following steps could be accomplished by a bladder control system, such as bladder control system 180. For example, some steps may be accomplished by an ECU of a bladder control system, such as ECU 150 of bladder control system 180. In other embodiments, some of the following steps could be accomplished by other components or systems associated with article 100. It will be understood that in other embodiments one or more of the following steps may be optional.

In step 202, bladder control system 180 may receive target pressure information. In particular, in some cases, bladder control system 180 receives a target pressure, which is a value indicating the desired or preset pressure for bladder 122. In some embodiments, the target pressure may be preset by a user, for example, using remote device 168, pressure control knob 169 or any other user input devices. In other embodiments, the target pressure may be automatically determined by bladder control system 180 using information from one or more sensors or other systems. As an example, bladder control system 180 may sense when the user is running on a rigid surface such as concrete or asphalt, and automatically adjust the target pressure to increase cushioning and/or shock absorption. This could be determined, for example, using information from pressure sensors, accelerometers as well as other kinds of sensors. As still another example, bladder control system 180 may sense when the user is engaged in low shock activities such as biking or walking, and could automatically lower the target pressure accordingly.

In step 204, bladder control system 180 may receive information from one or more sensors. In some embodiments, bladder control system 180 may receive information from a pressure sensor, such as pressure sensor 160. In such cases, the information may be used to determine a current pressure value indicative of the pressure inside bladder 122. Next, in step 206, bladder control system 180 may determine if the bladder pressure is equal to the target pressure. If so, bladder control system 180 may return to step 202. Otherwise, bladder control system 180 may proceed to step 208. It will be understood that during step 206, bladder control system 180 may determine if the current bladder pressure is within a predetermined error, or percentage, of the target pressure. For example, in one embodiment, bladder control system 180 may determine if the current bladder pressure is within 5% of the value of the target pressure.

In step 208, bladder control system 180 determines if the bladder pressure is above the target pressure. If not, bladder control system 180 proceeds to step 210. In other words, bladder control system 180 proceeds to step 210 when the bladder pressure is not equal to the target pressure (determined in step 206) and not above the target pressure (step 208), which implies that the bladder pressure must be less than the target pressure. Therefore, in step 210, bladder control system 180 enters the inflation mode, in which the pressure of bladder 122 is increased towards the desired target pressure.

If, in step 208, bladder control system 180 determines that the bladder pressure is above the target pressure, bladder control system 180 may proceed to step 212. In step 212, bladder control system 180 enters the deflation mode, in which the pressure of bladder 122 is decreased towards the desired target pressure.

Figure 6:
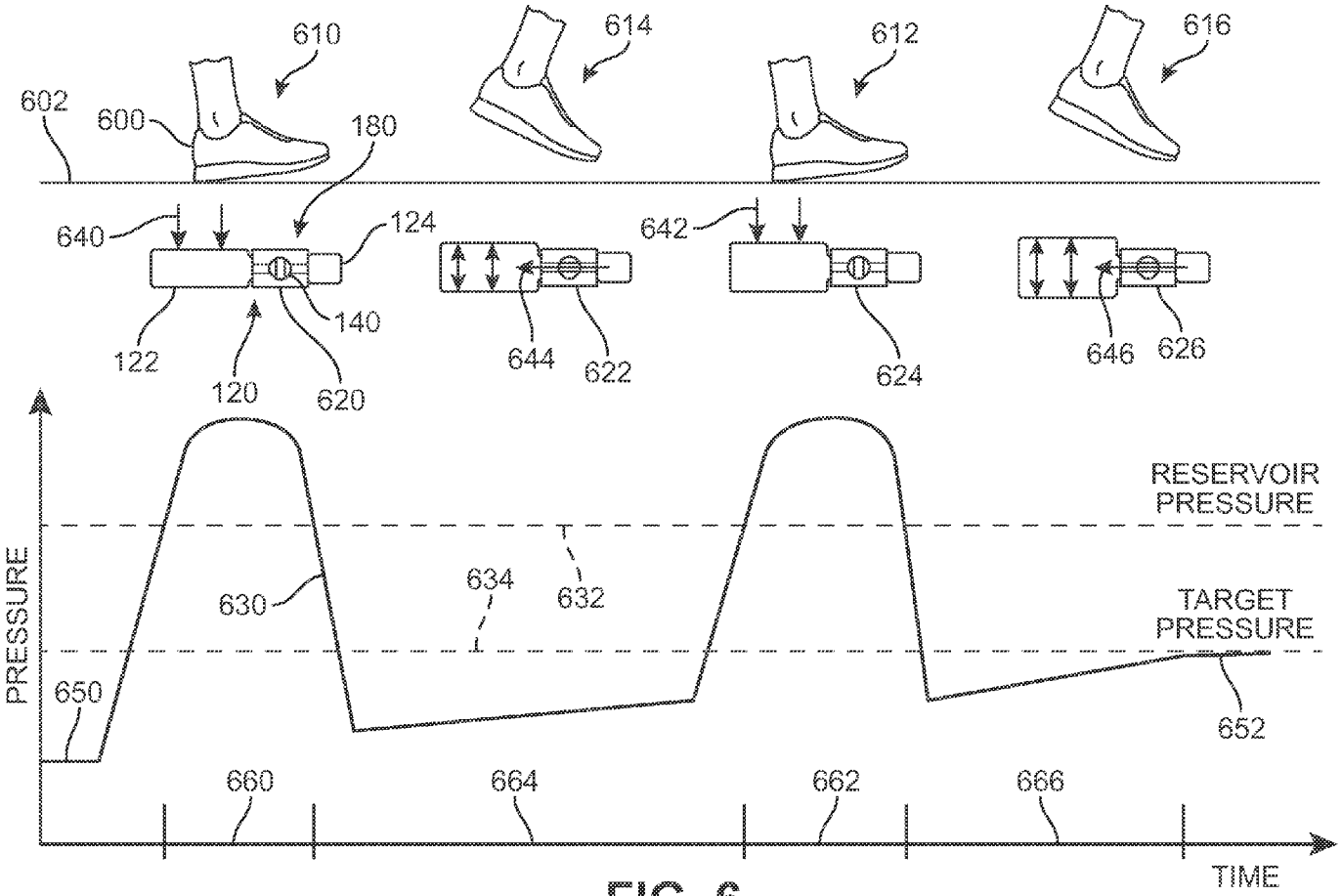
FIG. 6 is a schematic view of various stages of an inflation mode for a bladder control system.

FIG. 6 is a schematic view of various stages of the inflation mode, according to an embodiment. Referring to FIG. 6, during the inflation mode, electronically controlled valve 140 is automatically opened and closed during different phases of a walking/running motion. At the top of FIG. 6, article 600 is seen to be in different relative positions with respect to ground surface 602 during a sequence of motions that occur as a user takes steps forward (i.e., walks or runs). In particular, article 600 is shown in alternating heel strike positions (including first heel strike position 610 and second heel strike position 612) and lift-off positions (including first lift-off position 614 and second lift-off position 616). Below the schematic positions of article 600 are different operating stages of bladder assembly 120, which include different configurations of bladder 122 and different operating modes for electronically controlled valve 140. These operating stages include a first operating stage 620, a second operating stage 622, a third operating stage 624 and a fourth operating stage 626. Finally, the bottom of FIG. 6 shows a schematic plot of the pressure inside bladder 122 as a function of time. This plot includes bladder pressure 630, which varies in time, as well as reservoir pressure 632 and target pressure 634, which are substantially constant with time. Moreover, the times indicated in the plot generally correspond with the various article positions and operating stages of bladder assembly 120.

During the inflation mode, electronically controlled valve 140 is closed during heel strikes and opened in between heel strikes. For example, in the first operating stage 620 and third operating stage 624, which correspond to first heel strike position 610 and second heel strike position 612, respectively, electronically controlled valve 140 is closed. In contrast, in the second operating stage 622 and fourth operating stage 624, which correspond to first lift-off position 614 and second lift-off position 616, respectively, electronically controlled valve 140 is open. This arrangement prevents fluid from escaping bladder 122 during heel strikes, when downward forces (indicated schematically as first downward forces 640 and second downward forces 642) tend to compress bladder 122. Furthermore, this arrangement allows fluid to flow from reservoir 124 into bladder 122 in between heel strikes (the fluid flow is indicated schematically as first arrow 644 and second arrow 646), as the bladder pressure between heel strikes is substantially less than the reservoir pressure.

For purposes of describing the operation of bladder control system 180, reference is made to several periods of time. In particular, a first period of time 660 is a period of time when article 600 is in the first heel strike position 610. A second period of time 662 is a period of time when article 600 is in the second heel strike position 612. In addition, a third period of time 664 is a period of time between the first period of time 660 and the second period of time 662, and is generally a period of time between sequential heel strikes. Additionally, a fourth period of time 666 is a period of time that occurs after second period of time 662, and is generally a period of time when article 600 is in the second lift-off position 616. Each period of time is only intended to be approximate and in other embodiments the duration of each period could vary.

The process described here allows the bladder pressure to be iteratively increased towards the target pressure. In the current embodiment, for example, the bladder pressure has an initial value 650 that is substantially below target pressure 634. As article 100 contacts ground surface 602 in the first heel strike position 610, bladder control system 180 may detect a heel strike event and close (or keep closed) electronically controlled valve 140. In some embodiments, the heel strike event is determined using sensed pressure information. However, other embodiments could use any other means for detecting a heel strike event. In some cases, bladder control system 180 controls electronically controlled valve 140 in a closed position throughout the duration of the first period of time 660, which approximately corresponds with the time of the first heel strike event.

Next, as article 600 is lifted from ground surface 602 in the first lift-off position 614, bladder control system 180 may open electronically controlled valve 140 in order to allow fluid to flow from reservoir 124 to bladder 122. During this stage of operation, the bladder pressure gradually increases. In some cases, bladder control system 180 controls electronically controlled valve 140 in an opened position or state throughout the duration of the third period of time 664, which approximately corresponds with the time between the first heel strike event and a second heel strike event.

Next, article 100 makes contact again with ground surface 602 in the second heel strike position 612. At this point, bladder control system 180 may detect another heel strike event and closes electronically controlled valve 140. In some cases, bladder control system 180 controls electronically controlled valve 140 in a closed position or state throughout the duration of the second period of time 662, which approximately corresponds with the time of the second heel strike event.

Next, as article 100 is raised from ground surface 602 to the second lift-off position 616, bladder control system 180 opens electronically controlled valve 140 again in order to allow fluid to flow from reservoir 124 to bladder 122. During this stage of operation, the bladder pressure increases to the target pressure. Once the bladder pressure is equal to the target pressure, electronically controlled valve 140 may be closed once again, thereby maintaining the current bladder pressure of bladder 122 at the target pressure. Thus, this arrangement allows bladder 122 to be inflated during the time periods in between heel strikes, since the reservoir pressure is maintained at a high constant pressure so that absent of any compression forces, fluid will tend to flow from reservoir 124 to bladder 122.

Figure 7:
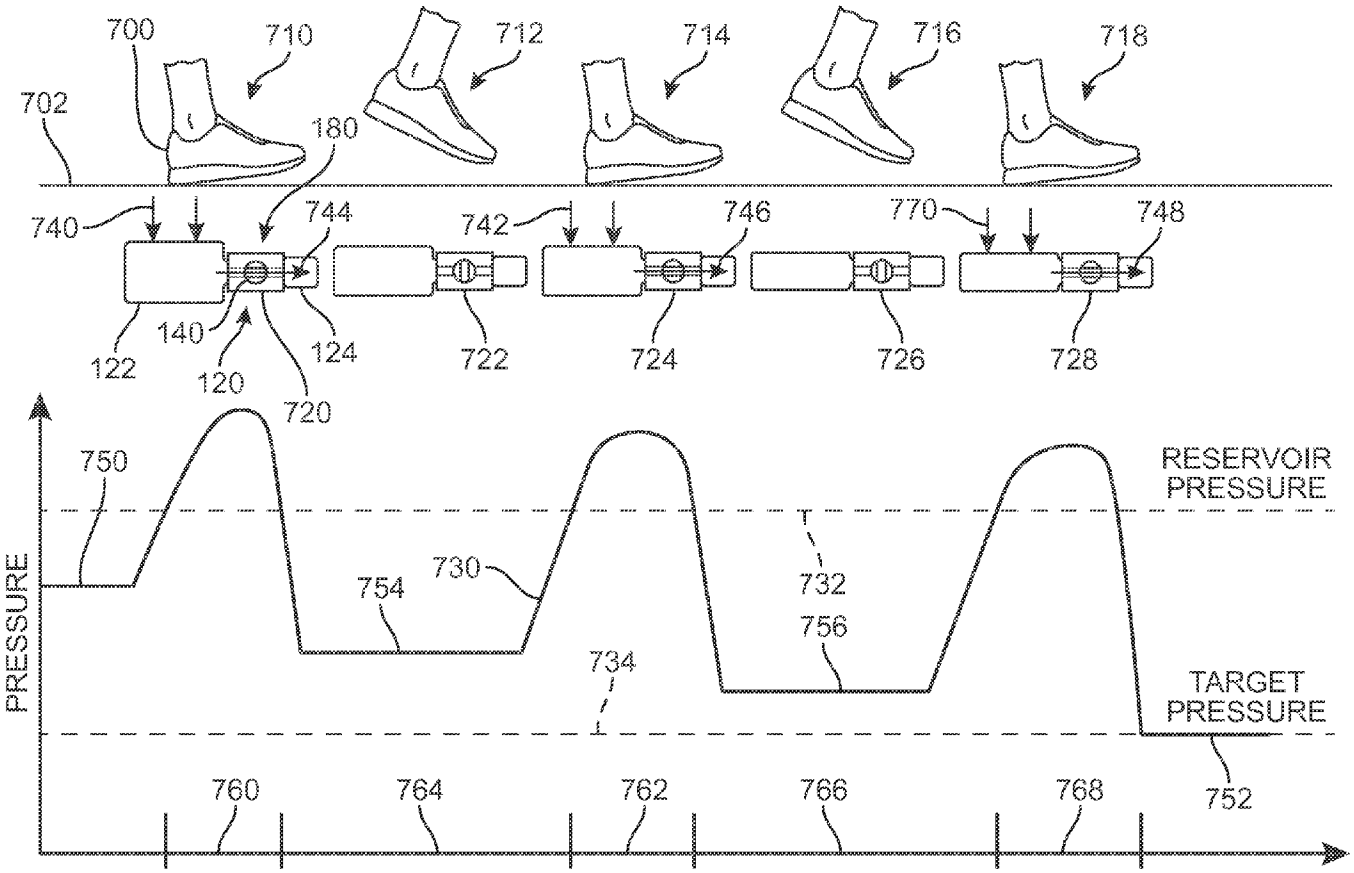
FIG. 7 is a schematic view of various stages of a deflation mode for a bladder control system.

FIG. 7 is a schematic view of various stages of the deflation mode, according to an embodiment. Referring to FIG. 7, during the deflation mode, electronically controlled valve 140 is automatically opened and closed during different phases of a walking/running motion. At the top of FIG. 7, article 700 is seen to be in different relative positions with respect to ground surface 702 during a sequence of motions that occur as a user takes steps forward (i.e., walks or runs). In particular, article 700 is shown in alternating heel strike positions (including first heel strike position 710, second heel strike position 714 and third heel strike position 718) and lift-off positions (including first lift-off position 712 and second lift-off position 716). Below the schematic positions of article 700 are different operating stages of bladder assembly 120, which include different configurations of bladder 122 and different operating modes for electronically controlled valve 140. These operating stages include a first operating stage 720, a second operating stage 722, a third operating stage 724 a fourth operating stage 726 and a fifth operating stage 728. Finally, below these operating stages a schematic plot of the pressure inside bladder 122 as a function of time is shown. This plot includes bladder pressure 730, which varies in time, as well as reservoir pressure 732 and target pressure 734, which are substantially constant with time.

During the inflation mode, electronically controlled valve 140 is opened during heel strikes and closed in between heel strikes. For example, in the first operating stage 720, third operating stage 724 and fifth operating stage 728, which correspond to first heel strike position 710, second heel strike position 714 and third heel strike position 718, respectively, electronically controlled valve 140 is open. In contrast, in the second operating stage 722 and fourth operating stage 726, which correspond to first lift-off position 712 and second lift-off position 716, respectively, electronically controlled valve 140 is open. This arrangement allows fluid to escape from bladder 122 during heel strikes, when downward forces (indicated schematically as first downward forces 740, second downward forces 742 and third downward forces 770) tend to compress bladder 122. In particular, this arrangement allows fluid to flow from bladder 122 to reservoir 124 during heel strikes (the fluid flow is indicated schematically as first arrow 744, second arrow 746 and third arrow 748), as the bladder pressure during heel strikes is substantially greater than the reservoir pressure.

For purposes of describing the operation of bladder control system 180 during the deflation mode, reference is made to several periods of time. In particular, a first period of time 760 is a period of time when article 700 is in the first heel strike position 710. A second period of time 762 is a period of time when article 700 is in the second heel strike position 714. In addition, a third period of time 764 is a period of time between the first period of time 760 and the second period of time 762, and is generally a period of time between sequential heel strikes. Additionally, a fourth period of time 766 is a period of time that occurs after second period of time 762, and is generally a period of time when article 700 is in the second lift-off position 716. Finally, a fifth period of time 768 is a period of time that generally occurs after the fourth period of time 766, and which also occurs while article 700 is in the third heel strike position 718. Each period of time is only intended to be approximate and in other embodiments the duration of each period could vary.

The process described here allows the bladder pressure to be iteratively decreased towards the target pressure. In the current embodiment, for example, the bladder pressure has an initial value 750 that is substantially above target pressure 734. As article 700 contacts ground surface 702 in the first heel strike position 710, bladder control system 180 may detect a heel strike event and open electronically controlled valve 140. In some embodiments, the heel strike event is determined using sensed pressure information. However, other embodiments could use any other means for detecting a heel strike event. In some cases, bladder control system 180 controls electronically controlled valve 140 in an open position throughout the duration of the first period of time 760, which approximately corresponds with the time of the first heel strike event. During this stage of operation, the uncompressed pressure of bladder 122 decreases from the initial value 750 to first intermediate value 754.

Next, as article 700 is lifted from ground surface 702 in the first lift-off position 712, bladder control system 180 may close electronically controlled valve 140 in order to prevent fluid in reservoir 124 from flowing back into bladder 122, since reservoir 124 is maintained at a substantially greater pressure than bladder 122. In some cases, bladder control system 180 controls electronically controlled valve 140 in an opened position or state throughout the duration of the third period of time 764, which approximately corresponds with the time between the first heel strike event and a second heel strike event. In this stage of operation, the pressure of bladder 122 remains approximately constant.

Next, article 700 makes contact again with ground surface 702 in the second heel strike position 714. At this point, bladder control system 180 may detect another heel strike event and opens electronically controlled valve 140. In some cases, bladder control system 180 controls electronically controlled valve 140 in an open position or state throughout the duration of the second period of time 762, which approximately corresponds with the time of the second heel strike event. During this stage of operation, the uncompressed pressure of bladder 122 decreases from first intermediate value 754 to second intermediate value 756.

Next, as article 700 is raised from ground surface 702 to the second lift-off position 716, bladder control system 180 closes electronically controlled valve 140 again in order to prevent fluid from flowing back to bladder 122 from reservoir 124. As seen in FIG. 7, the pressure of bladder 122 in the fourth operating stage 726 is substantially lower than the pressure of bladder 122 in the second operating stage 722.

Next, article 700 makes contact again with ground surface 702 in the third heel strike position 718. At this point, bladder control system 180 may detect another heel strike event and opens electronically controlled valve 140. In some cases, bladder control system 180 controls electronically controlled valve 140 in an open position or state throughout the duration of the fifth period of time 768, which approximately corresponds with the time of the third heel strike event. During this stage of operation, the bladder pressure decreases to the target pressure. As seen in FIG. 7, during this stage of operation bladder pressure 730 obtains a final value 752 that is approximately equal to target pressure 734. Once bladder pressure 730 is equal to target pressure 734, electronically controlled valve 140 may be closed once again, thereby maintaining the current bladder pressure of bladder 122 at the target pressure 734.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

The invention claimed is:

1. An article of footwear comprising:

a bladder;

a reservoir;

an electronically controlled valve having a fluid port in fluid communication with the bladder and a fluid port in fluid communication with the reservoir;

an antenna;

a pressure sensor configured to output bladder pressure values; and an electronic control unit configured to receive information from the antenna and information from the pressure sensor, and further configured to determine if a target pressure value received from the antenna and representing a target pressure is greater than or less than a current bladder pressure value received from the pressure sensor and representing a current bladder pressure, as a result of determining the target pressure value is less than the current bladder pressure value, iteratively reduce bladder pressure by opening the valve during heel strikes, and then maintain bladder pressure substantially at the target pressure until a new target pressure value is received from the antenna, and as a result of determining the target pressure value is greater than the current bladder pressure value, iteratively increase bladder pressure by opening the valve between heel strikes, and then maintain the bladder pressure substantially at the target pressure until a new target pressure value is received from the antenna.

2. The article of footwear of claim 1, wherein the electronic control unit is configured to iteratively increase bladder pressure by closing the valve during a first heel strike event, causing a maximum pressure in the bladder during a time period between the first heel strike event and a sequential second heel strike event to reach a first pressure level by opening the valve during at least a portion of the time period between the first and second heel strike events, closing the valve during the second heel strike event, and causing a maximum pressure in the bladder during a time period after the second heel strike event to reach a second pressure level by opening the valve during at least a portion of the time period after the second heel strike event, the second pressure level being greater than the first pressure level.

3. The article of footwear of claim 1, wherein the electronic control unit is configured to iteratively decrease bladder pressure by opening the valve during a first heel strike event, maintaining a first pressure level in the bladder during a time period between the first heel strike event and a sequential second heel strike event by closing the valve during the time period between the first and second heel strike events, opening the valve during the second heel strike event, and maintaining a second pressure level in the bladder during a time period after the second heel strike event by closing the valve during the time period after the second heel strike event, the second pressure level being less than the first pressure level.

4. The article of footwear of claim 1, wherein the pressure of the reservoir is substantially constant.

5. The article of footwear of claim 1, further comprising a sole structure, and wherein the bladder, the reservoir, and the valve are located in the sole structure.

6. The article of footwear of claim 1, wherein the bladder and the reservoir are filled with one or more gases, wherein opening the valve allows transfer of gas between the bladder and the reservoir, and wherein closing the valve prevents transfer of gas between the bladder and the reservoir.

7. The article of claim 1, further comprising a second valve configurable to place the bladder in fluid communication with an external fluid source.

8. An article of footwear comprising:

a bladder and a reservoir, wherein the bladder and the reservoir are filled with one or more gases;

an electronically controlled valve having a fluid port in fluid communication with the bladder and a fluid port in fluid communication with the reservoir;

a pressure sensor configured to output bladder pressure values; and an electronic control unit configured to receive information from the pressure sensor and to iteratively open the valve to permit transfer of the one or more gases to the bladder from the reservoir, or from the bladder to the reservoir, until a target bladder pressure is reached.

9. The article of footwear of claim 8, further comprising a second valve configurable to place the bladder in fluid communication with an external fluid source.

10. The article of footwear of claim 8, wherein the pressure of the reservoir is substantially constant.

11. The article of footwear of claim 8, further comprising a sole structure, and wherein the bladder, the reservoir, and the valve are located in the sole structure.

12. The article of footwear of claim 8, wherein the electronic control unit is configured to iteratively increase bladder pressure by closing the valve during a first heel strike event, causing a maximum pressure in the bladder during a time period between the first heel strike event and a sequential second heel strike event to reach a first pressure level by opening the valve during at least a portion of the time period between the first and second heel strike events, closing the valve during the second heel strike event, and causing a maximum pressure in the bladder during a time period after the second heel strike event to reach a second pressure level by opening the valve during at least a portion of the time period after the second heel strike event, the second pressure level being greater than the first pressure level.

13. The article of footwear of claim 8, wherein the electronic control unit is configured to iteratively decrease bladder pressure by opening the valve during a first heel strike event, maintaining a first pressure level in the bladder during a time period between the first heel strike event and a sequential second heel strike event by closing the valve during the time period between the first and second heel strike events, opening the valve during the second heel strike event, and maintaining a second pressure level in the bladder during a time period after the second heel strike event by closing the valve during the time period after the second heel strike event, the second pressure level being less than the first pressure level.

14. The article of footwear according to claim 8, wherein the electronic control unit is configured to receive speed information regarding a traveling speed of the article of footwear.

15. The article of footwear according to claim 8, wherein the electronic control unit is configured to receive distance information regarding a distance traveled by a user of the article of footwear.

16. The article of footwear according to claim 8, wherein the electronic control unit is configured to receive acceleration information regarding acceleration of the article of footwear.

17. The article of footwear according to claim 8, wherein the electronic control unit is configured to receive GPS information.

* * * * *